US012397831B2

(12) United States Patent
Upadhyay

(10) Patent No.: US 12,397,831 B2
(45) Date of Patent: Aug. 26, 2025

(54) TRAIN COUPLER, SYSTEM AND METHOD FOR AUTOMATIC COUPLING TRAINS, AND RELATED TRAIN

(71) Applicant: ALSTOM HOLDINGS, St Ouen sur Seine (FR)

(72) Inventor: Ashwani Upadhyay, Bangalore (IN)

(73) Assignee: Alstom Holdings, Saint-Ouen-sur-Seine (FR)

( * ) Notice: Subject to any disclaimer, the term of this patent is extended or adjusted under 35 U.S.C. 154(b) by 888 days.

(21) Appl. No.: 17/645,420

(22) Filed: Dec. 21, 2021

(65) Prior Publication Data

US 2022/0204059 A1 Jun. 30, 2022

(30) Foreign Application Priority Data

Dec. 24, 2020 (IN) ..... 202041056241

(51) Int. Cl.
*B61G 5/08* (2006.01)
*B61G 3/20* (2006.01)
*B61G 5/10* (2006.01)

(52) U.S. Cl.
CPC ..... *B61G 5/08* (2013.01); *B61G 3/20* (2013.01); *B61G 5/10* (2013.01)

(58) Field of Classification Search
CPC ..... B61G 3/20; B61G 5/08; B61G 5/10
See application file for complete search history.

(56) References Cited

U.S. PATENT DOCUMENTS 3,842,987 A * 10/1974 Prada ..... H01R 43/26 213/1.3
2014/0284297 A1* 9/2014 Peckham ..... B61G 7/12 213/75 R

* cited by examiner

*Primary Examiner* — Robert J McCarry, Jr.
(74) *Attorney, Agent, or Firm* — Knobbe, Martens, Olson & Bear, LLP

(57) ABSTRACT

A train coupler includes a mechanical coupler configured to couple with another train coupler, a primary pneumatic circuit, which includes a main air distribution line adapted to be connected with and supply air into a pneumatic circuit of the other train coupler, via a first inlet/outlet, an electrical head connected to a first actuator configured to be pneumatically actuated and drive the electrical head to move between a retracted position and an extended position where it is electrically coupled with an electrical head of the another train coupler, and a secondary pneumatic circuit pneumatically connected to the primary pneumatic circuit and arranged to convey flows of air derived from the main air distribution line towards the first actuator and a second inlet/outlet.

13 Claims, 6 Drawing Sheets

TRAIN COUPLER, SYSTEM AND METHOD FOR AUTOMATIC COUPLING TRAINS, AND RELATED TRAIN

CROSS-REFERENCE TO RELATED APPLICATION

This application claims priority to Indian Patent Application No. 202041053241 filed on Dec. 24, 2020, the disclosure of which including the specification, the drawings, and the claims is hereby incorporated by reference in its entirety.

FIELD OF THE INVENTION

The present invention concerns a train coupler, a system and a method for automatic coupling trains, in particular for automatically coupling the trains mechanically, pneumatically and electrically, and a train comprising such a train coupler.

BACKGROUND OF THE INVENTION

As known, in railway operations, coupling of two trains can be necessary to obtain a convoy operating with multiple units, or for rescuing a faulty train.

To this end, trains are provided at their front with an automatic coupler equipped with suitable mechanical, pneumatic and electrical coupling means controlled according to solutions rather complex and anyway not always effective.

For instance, one drawback of known automatic coupling solutions resides in the fact that a certain low voltage supply must be always available on both trains in order to realize automatically their electrical coupling, which helps to control line signals, including for example brake controls, from the healthy train to the failed one.

Clearly, this is not the case during rescue operations of a train which is under a complete failure and therefore does not have any power supply available on board in such faulty condition.

Therefore, in such circumstances, it is not possible to complete automatically also the electrical coupling, and an operator is forced to go on the track and to manually connect the electrical mating parts of both trains.

Clearly, this solution is not entirely satisfying at least under a safety point of view.

SUMMARY OF THE INVENTION

The present invention is aimed at facing such issue and in particular to provide a solution which allows to couple mechanically, pneumatically and electrically two trains automatically, even when one of the two trains is completely dead from an electrical point of view, in a safer and simplified manner with respect to known solutions.

This aim is achieved by a train coupler comprising:

- mechanical means for mechanically coupling with another train coupler;
- a primary pneumatic circuit comprising a main air distribution line adapted to be connected with and supply air into a pneumatic circuit of said another train coupler, via a first inlet/outlet;
- a movable electrical head connected to first actuating means which are configured to be pneumatically actuated and drive the electrical head to move between a non-operative retracted position and an extended position where it is adapted to be electrically coupled with an electrical head of said another train coupler;

- a secondary pneumatic circuit which is pneumatically connected to said primary circuit and is arranged to convey flows of air derived from said main air distribution line towards said first actuating means and a second inlet/outlet, the second pneumatic circuit being suitable to be pneumatically connected with the pneumatic circuit of said another train coupler via the second inlet/outlet, wherein said secondary pneumatic circuit is configured to be switched, based on an electrical activation signal generated by a train control unit, between a first operative configuration where the derived flows of air towards said first actuating means and said second inlet/outlet are blocked, and a second operative configuration where said derived flows of air are permitted pneumatically actuating at least said first actuating means to drive the electrical head to move to the extended position for electrically coupling with the electrical head of said another train coupler.

Further, the above mentioned aim is also achieved by a coupling system for coupling a first train to a second train comprising:

- a first train coupler as above indicated, and in particular as described hereinafter and defined in the appended claims, which is installed on said first train;
- a second train coupler as above indicated, and in particular as described hereinafter and defined in the appended claims, which is installed on said second train;
- a first control unit which is installed on board of said first train and is configured to generate an electrical activation signal suitable to switch the secondary pneumatic circuit of the first train coupler between its first operative configuration and its second operative configuration;
- a second control unit which is installed on board of said second train and is configured to generate an electrical activation signal suitable to switch the secondary pneumatic circuit of the second train coupler between its first operative configuration and its second operative configuration;

wherein, upon mechanically and pneumatically coupling said first train coupler with said second train coupler, the issuance of an electrical activation signal, by one of the first and second control units switches the secondary pneumatic circuit of the corresponding first or second train couplers from its first operative configuration to its second operative configuration where flows of air are permitted, inside the secondary pneumatic circuit of both the first and second train couplers, and pneumatically actuate the first actuating means of both the first and second train couplers to drive the respective electrical heads to move to the respective extended position and electrically couple to each other.

In addition, the above mentioned aim is also achieved by a train comprising a train coupler including:

- mechanical means for mechanically coupling with another train coupler;
- a primary pneumatic circuit comprising a main air distribution line adapted to be connected with and supply air into a pneumatic circuit of said another train coupler, via a first inlet/outlet;
- a movable electrical head connected to first actuating means which are configured to be pneumatically actuated and drive the electrical head to move between a non-operative retracted position and an extended position where it is adapted to be electrically coupled with an electrical head of said another train coupler;
- a secondary pneumatic circuit which is pneumatically connected to said primary circuit and is arranged to convey flows of air derived from said main air distribution line towards said first actuating means and a second inlet/outlet, the second pneumatic circuit being suitable to be pneumatically connected with the pneumatic circuit of said another train coupler via the second inlet/outlet, wherein said secondary pneumatic circuit is configured to be switched, based on an electrical activation signal generated by a train control unit, between a first operative configuration where the derived flows of air towards said first actuating means and said second inlet/outlet are blocked, and a second operative configuration where said derived flows of air are permitted pneumatically actuating at least said first actuating means to drive the electrical head to move to the extended position for electrically coupling with the electrical head of said another train coupler.

Finally, the above mentioned aim is also achieved by a method for coupling trains, comprising:

(a): driving a first train comprising a first train coupler towards a second train comprising a second train coupler, said first and second train coupler comprising each:

respective mechanical means for mechanically coupling to each other the first and second train couplers;

a respective primary pneumatic circuit comprising a main air distribution line adapted to be connected with and supply air into a pneumatic circuit of the other train coupler, via a first inlet/outlet;

a respective movable electrical head connected to respective first actuating means which are configured to be pneumatically actuated and drive the electrical head to move between a non-operative retracted position and an extended position where it is adapted to be electrically coupled with an electrical head of the other train coupler;

a respective secondary pneumatic circuit which is pneumatically connected to said primary circuit and is arranged to convey flows of air derived from said main air distribution line towards said first actuating means and a second inlet/outlet, the second pneumatic circuit being suitable to be pneumatically connected with the pneumatic circuit of the other train coupler via the second inlet/outlet, wherein said secondary pneumatic circuit is configured to be switched, based on an electrical activation signal generated by a train control unit, between a first operative configuration where the derived flows of air towards said first actuating means and said second inlet/outlet are blocked, and a second operative configuration where said derived flows of air are permitted pneumatically actuating at least said first actuating means to drive the respective electrical head to move to the extended position for electrically coupling with the electrical head of the other train coupler;

(b): coupling mechanically and pneumatically said first train coupler to said second train coupler;

(c): issuing, via a control unit installed on one of the first and second trains an electrical activation signal switching the corresponding secondary pneumatic circuit of the first or second train couplers from its first operative configuration to its second operative configuration where derived flows of air are permitted, inside both the secondary pneumatic circuits of the first and second train couplers, pneumatically actuating the respective first actuating means to drive the corresponding electrical heads of the first and second train couplers into the respective extended position and electrically couple to each other.

BRIEF DESCRIPTION OF THE DRAWINGS

Further characteristics and advantages will become apparent from the description of some preferred but not exclusive exemplary embodiments of a train coupler, coupling system and method, and related train, according to the present invention, illustrated only by way of non-limitative examples with the accompanying drawings, wherein.

Figure 1:
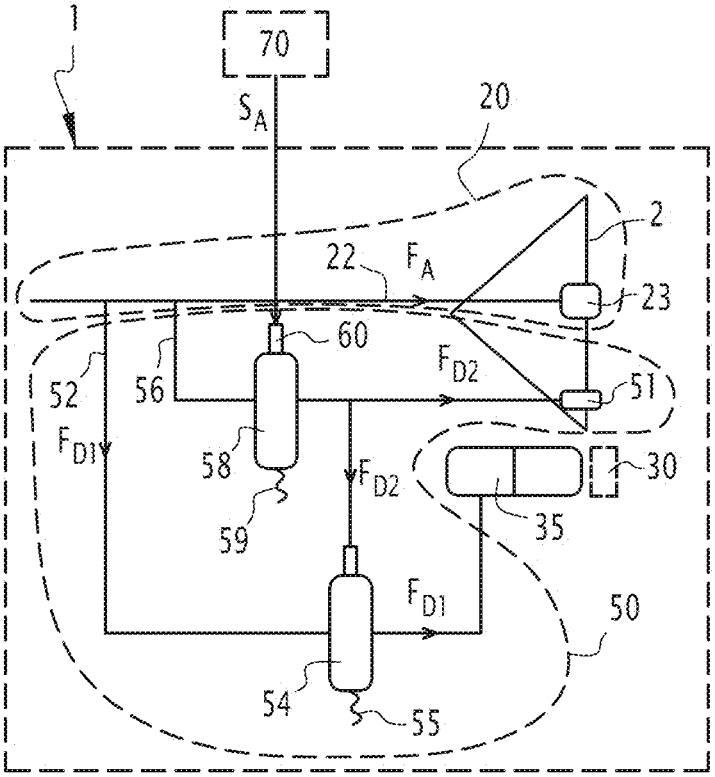
FIG. 1 is a block diagram schematically showing a train coupler according to the present invention.

It should be noted that in the detailed description that follows, identical or similar components, either from a structural and/or functional point of view, may have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

DETAILED DESCRIPTION OF THE PREFERRED EMBODIMENTS

Further, when the term "adapted" or "arranged" or "configured" or "shaped", or a similar term is used herein while referring to any component as a whole, or to any part of a component, or to a combination of components, it has to be understood that it means and encompasses correspondingly either the structure, and/or the configuration and/or the form and/or the positioning.

In particular, for electronic and/or software means, each of the above listed terms means and encompasses electronic circuits or parts thereof, as well as stored, embedded or running software codes and/or routines, algorithms, or complete programs, suitably designed for achieving the technical result and/or the functional performances for which such means are devised.

In addition, when the term "substantial" or "substantially" is used herein, it has to be understood as encompassing an actual variation of plus or minus 5% with respect to an indicated reference value, time or position.

Finally, in the following description and claims, the numeral cardinals first, second, third et cetera . . . , can be used only for the sake of clarity of description and in no way they should be understood as limiting for whatsoever reason; in particular, the indication of a component referred to for instance as the "third . . . " does not imply necessarily the presence or strict need of the preceding "first" or "second" ones, unless such presence is clearly evident for the correct functioning of the relevant embodiment(s) described, nor that the order should be the one exactly in the numerical sequence described with reference to the illustrated exemplary embodiment(s).

Figure 3:
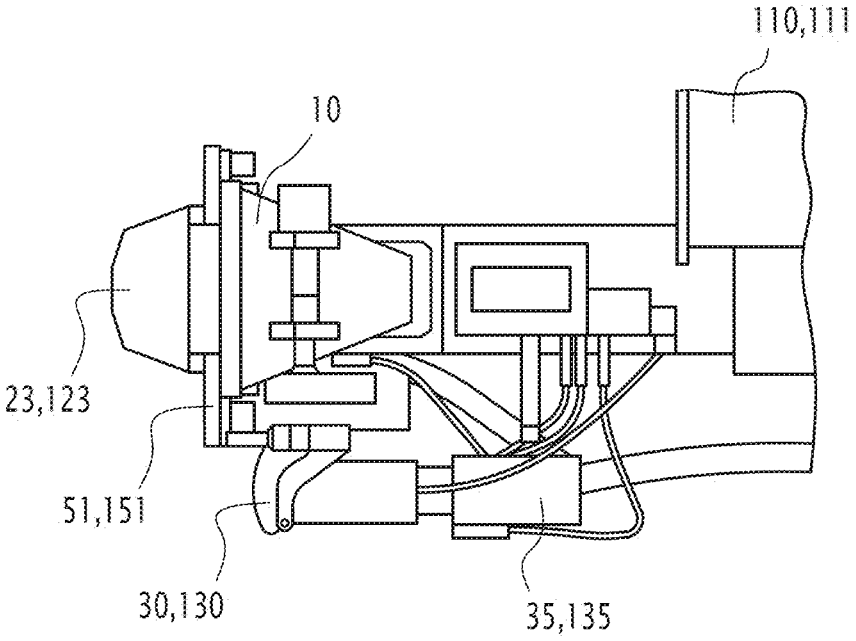
FIG. 3 is a perspective view showing an exemplary embodiment of a train coupler according to the invention.

FIG. 1 illustrates schematically a train coupler according to the invention, indicated by the overall reference number 1, which is suitable to be mounted on the front head of a train, partially represented in FIG. 3 by the reference number 110.

Figure 2:
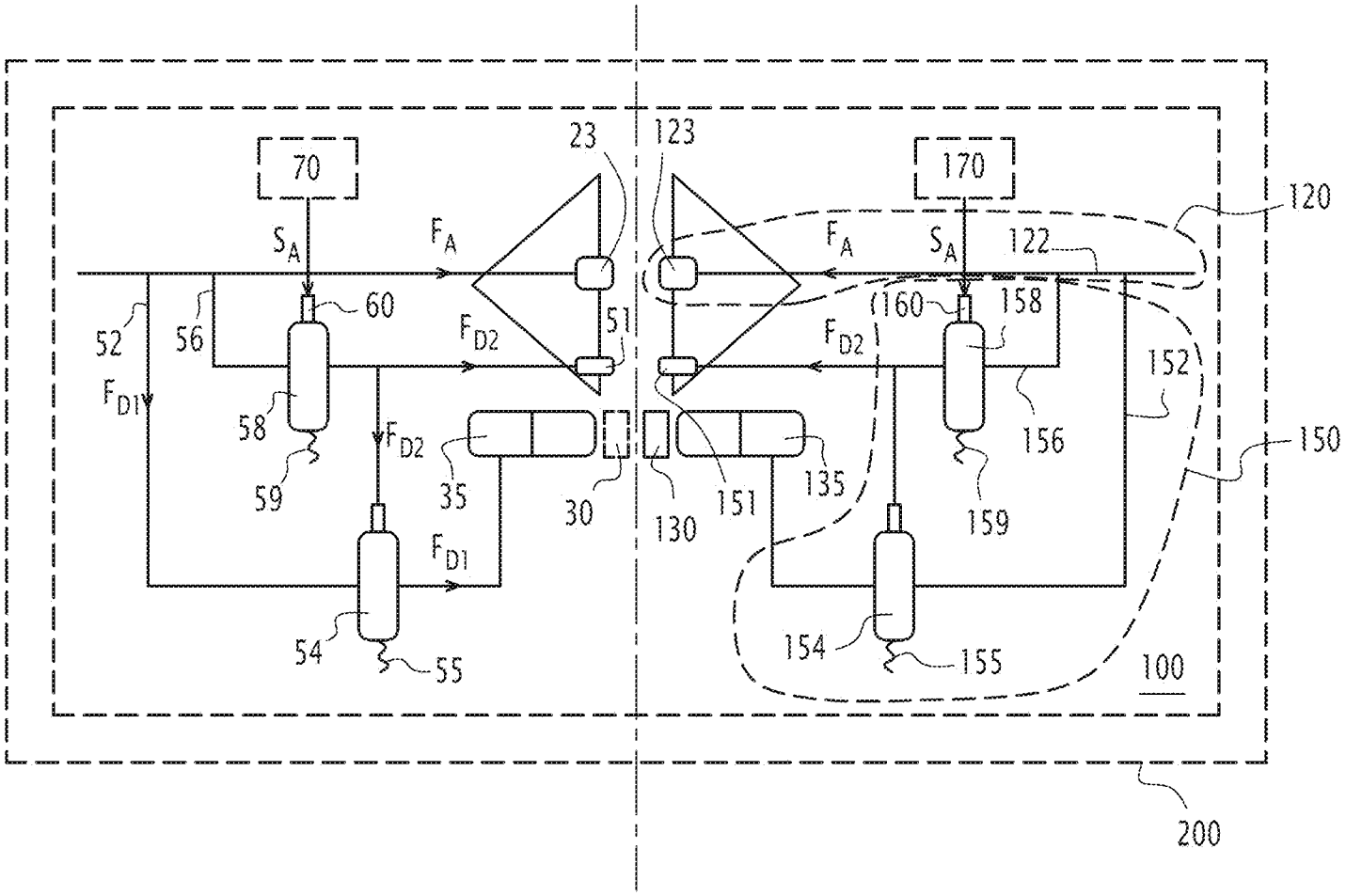
FIG. 2 is a block diagram schematically showing a coupling system with two train couplers according to the invention under coupling.

In the following description, reference will be made to an embodiment where coupling of two trains is realized by using two train couplers 1 substantially identical to each other;

To this end, FIG. 2 illustrates a coupling system 200 for coupling two trains, wherein each of the trains comprises a respective train coupler; in particular, in the coupling system 200 of FIG. 2 there are illustrated two train couplers according to the present invention, out of which the second one, hereinafter referred to also as the second or the another train coupler, is indicated by the reference number 100 only for the sake of clarity of description.

Clearly, even if such embodiment is preferable, the train coupler 1 according to the invention can be used for coupling with another train coupler not necessarily identical provided that such other train coupler is compatible for coupling with the train coupler 1 as devised within the frame of the present invention.

The train coupler 1 comprises mechanical means for mechanically coupling with the train coupler of another train.

Figure 4:
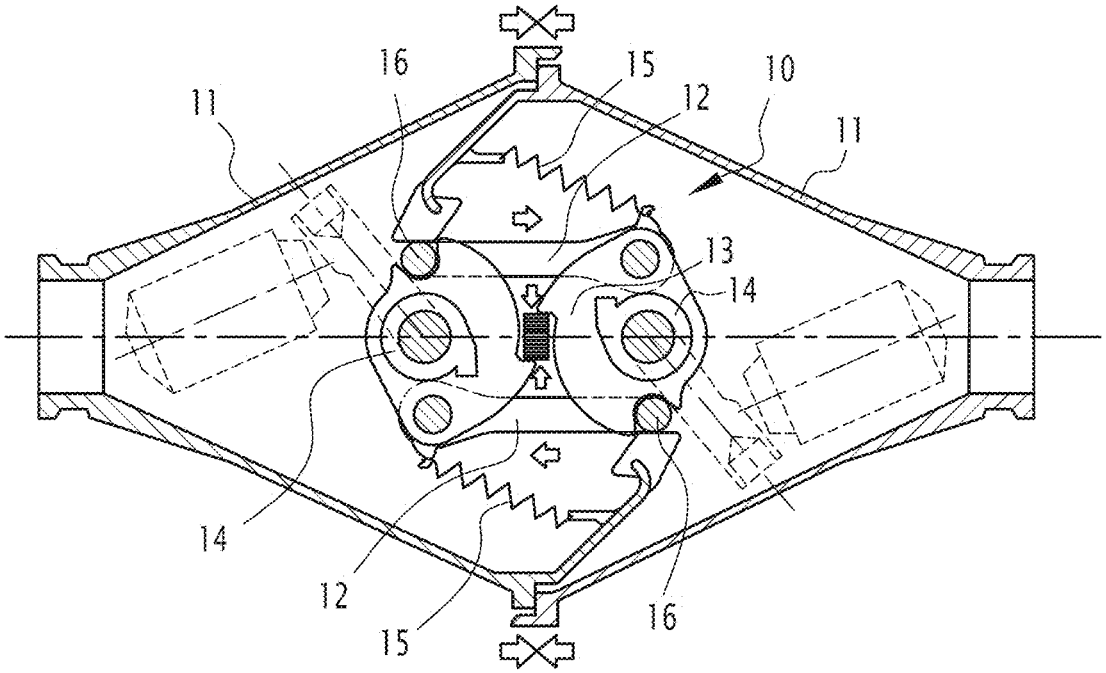
FIG. 4 is a view schematically showing two train couplers of the type illustrated in FIG. 3 mechanically coupled to each other.

An exemplary embodiment of such mechanical means is schematically illustrated in FIG. 4, where they are indicated by the overall reference number 10; such mechanical means can be realized according to different solutions known in the art or readily available to those skilled in the art and therefore not described herein in particular details.

For instance, according to the exemplary embodiment illustrated in FIG. 4, during coupling the cones 11 of the mating train couplers, for example the train couplers 1 and 100, slide one into the other and the coupling links 12 of each coupler hits the hooked plates 13 of the other mating coupler. The coupler locks 14 turn against the force of the tension springs 15 until the coupling links 12 engage into the recesses 16 of the hooked plate 13. After locking, the coupler locks 14 are rotated to the coupled position by the force of the tension springs 15. In this way, the mechanical coupling between the two couplers is established.

The train coupler 1 according to the invention further comprises a primary pneumatic circuit, indicated in FIG. 1 by the overall reference number 20, which comprises a main air distribution line or pipe 22 which is adapted to be connected at its first connection inlet/outlet 23, to a corresponding connection inlet/outlet of the pneumatic circuit of the other train coupler.

In particular, according to the embodiment schematically illustrated in FIG. 2, the other train coupler 100 comprises a substantially identical primary pneumatic circuit, indicated by the reference number 120, which includes also a main air distribution pipe 122 with a first connection inlet/outlet 123.

In this embodiment, the main air distribution line 22 of the train coupler 1 is pneumatically connected at its inlet/outlet 23 to the corresponding first inlet/outlet 123.

Once the pneumatic connection between the two train couplers is perfected, the main air distribution line 22 supplies flows of air, namely compressed air, indicated by the arrow $F_A$ in the figures, from a source or reservoir on board of the first train 110 into the second train, indicated in FIG. 3 by the reference number 111, via at least the primary pneumatic circuit 120 of the second train coupler 100.

Also such pneumatic coupling can be realized according to various solutions known in the art or readily available to those skilled in the art and therefore not described herein in particular details.

Figure 5:
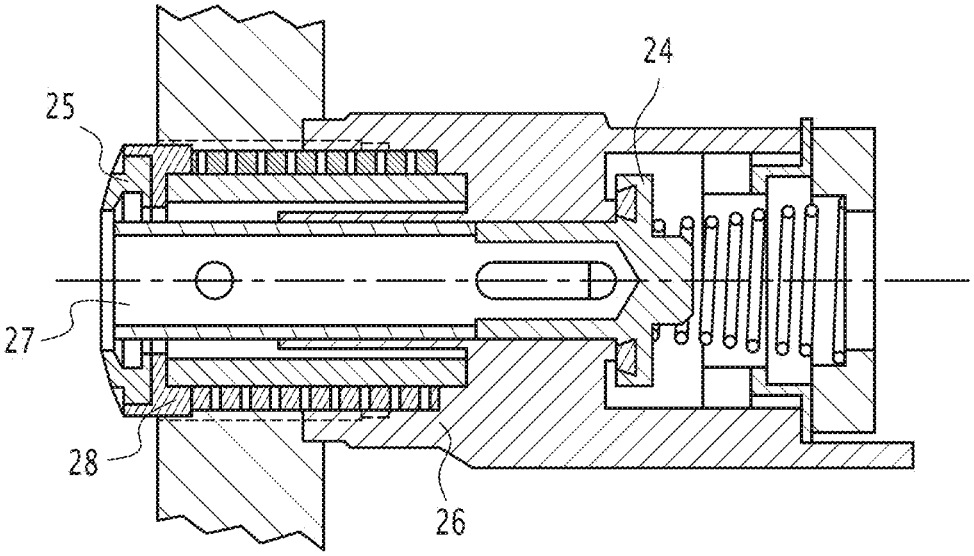
FIG. 5 is a view schematically showing an exemplary portion of a head face of a train coupler with a valve which can be used for pneumatically connecting the train coupler according to the invention with another train coupler.

For instance, in the exemplary embodiment illustrated, the main air distribution line or pipe 22 is for example located in the center of the train coupler 1 and the connection is realized, at a coupling face 2, via an assembly, schematically illustrated in FIG. 5, which comprises a valve 24 and a mouth piece 25. For example, the mouth piece 25 is clamped between the face 2 and the valve 24; in turn, the valve 24 is located at the rear side of the coupler face 2. For instance, the valve comprises a casing 26 and a tappet 27. The mouth piece 25 protrudes from the coupler face 2 and is protected from the penetration of contaminants, such as dust or water, by means of one or more suitable rubber closed seals/gaskets 28.

The train coupler 1 according to the invention comprises also a movable electrical head, indicated in FIGS. 1-3, by the reference 30, which is connected to first actuating means 35 configured to be pneumatically actuated so as, once actuated, they drive the electrical head 30 to move between a retracted position where it is in an electrically disconnected configuration and an extended position where it electrically couples with an electrical head of another coupler, such as the electrical head 130 of the second train coupler 100.

The first actuating means 35 comprise for example a pneumatic cylinder.

Conveniently, the train coupler 1 according to the invention comprises a secondary pneumatic circuit, schematically indicated in FIG. 1 by the reference number 50, which is pneumatically connected to the primary circuit 20 and is arranged to convey flows of air $F_D$ derived from the main air distribution line 22, at least towards the actuating means 35 of the electrical head 30, and preferably also towards the pneumatic circuit of the second train coupler.

In particular, the secondary pneumatic circuit 50 comprises a second outlet/inlet 51 through which flows of air derived from the primary circuit 20 are supplied into the pneumatic circuit of the other train coupler at a pneumatic connection point different from that where the main distribution line 22 is connected to.

To this end, and according to the embodiment illustrated in FIG. 2, the pneumatic circuit 120 of the second train coupler 100 comprises also a secondary pneumatic circuit 150, preferably substantially identical to the secondary pneumatic circuit 50 of the first train coupler 1, comprising also a corresponding second outlet/inlet 151 to be connected with the second outlet/inlet 51.

Usefully, the secondary pneumatic circuit 50 is configured to be switched, as a whole, and following an electrical activation signal $S_A$ generated by a train control unit, schematically indicated in FIG. 1 by the reference number 70, between a first operative configuration where the conveyance of the derived flows of air $F_D$ towards the actuating means 35 and towards the second outlet/inlet 51 (and hence towards the secondary pneumatic circuit 150 of the another train coupler, e.g. the second train coupler 100), are blocked, and a second operative configuration where said derived flows of air $F_D$ are permitted at least for pneumatically actuating the actuating means 35 so that they drive the electrical head 30 to move to the extended position and electrically couple with the electrical head of the other train coupler, namely in the example illustrated the electrical head 130 of the second train coupler 100.

More in details, according to the example illustrated in FIG. 1, the secondary pneumatic circuit 50 comprises a first air distribution line 52 which is arranged to convey first flows of air $F_{D1}$ derived from the main air distribution line 22 towards the actuating means 35.

As illustrated, the secondary pneumatic circuit 50 comprises also first flow-control means, schematically indicated by the reference number 54, which are positioned along the first air distribution line 52 and are configured to be actuated pneumatically to move from a first normally blocking position where the first flows of air $F_{D1}$ to be conveyed towards the first actuating means 35 are blocked, and an actuated second position where such first flows of air Fiji towards the first actuating means 35 are instead permitted.

According to a possible embodiment, the first flow-control means 54 comprise a first bistable valve comprising for instance elastic means, for example a spring, schematically indicated in FIG. 1 by the reference number 55.

The elastic means 55 are configured to urge the first bistable valve in its first normally blocking position.

In particular, the first bistable valve is a five-way-two-position valve.

In the train coupler 1 according to the invention, the secondary pneumatic circuit 50 further comprises a second air distribution line 56 which is arranged to convey second flows of air $F_{D2}$ derived from the main air distribution line 22 towards the first control means 54, and towards the pneumatic circuit of the other train coupler, and in particular, according to the example illustrated in FIG. 2, towards the second inlet/outlet 51 connected to the associated second inlet/outlet 151.

According to the exemplary embodiment illustrated in FIG. 1, the secondary pneumatic circuit 50 comprises second flow-control means 58 which are positioned along the second air distribution line 56 and are configured to be activated electrically by the electrical activation signal $S_A$ to switch from a first normally blocking position where the second flows of air $F_{D2}$ to be conveyed towards the first control means 54 and towards the second outlet/inlet 51 (and thus towards the pneumatic circuit of the other train coupler) are blocked, and an electrically actuated second position where the derived second flows of air $F_{D2}$ are allowed.

In this way, the pneumatic action of such second flows of air $F_{D2}$ overcomes the urging force of the elastic means 55 and moves the first control means 54, and in particular the first bistable valve, from its first normally blocking position into the actuated second position.

Further, the second flows of air $F_{D2}$ are also conveyed towards the second outlet/inlet 51 and, according to the example of FIG. 2, they can flow into the pneumatic circuit of the other train coupler, e.g. inside the secondary pneumatic circuit 150 via the mating inlet/outlet 151 and advantageously actuate also the second actuating means 135 of the other train coupler 100.

According to a possible embodiment, the second flow-control means 58 comprise a second bistable valve comprising for instance elastic means, for example a spring, schematically indicated in FIG. 1 by the reference number 59, and an actuating solenoid 60.

The elastic means 59 are configured to urge the second bistable valve in its first normally blocking position, while the reception of the electrical activation signal $S_A$ activates the solenoid 60 that causes the movable part of the second bistable valve to overcome the urging force of the elastic means 59 and move into its actuated second position.

In particular, the second bistable valve is a three-way-two-position valve.

The train coupler 1 according to the invention can be installed on and used in principle with any type of suitable trains.

In particular, as previously mentioned, it is particularly advantageous to use the train coupler 1 in order to couple two trains each having a respective train coupler 1, as for example illustrated for the coupling system 200 of FIG. 2.

As illustrated, the coupling system 200 comprises a first train coupler 1 according to the invention, which is installed on the front head the first train 110;

- a second train coupler according to the invention, indicated for the sake of clarity of illustration by the reference number 100, which is installed on the front head of the second train 111;
- a first control unit 70 which is installed on board of the first train 110 and is configured to generate an electrical activation signal $S_A$ suitable to switch the secondary pneumatic circuit 50 of the first train coupler 1 between its first operative condition and its second operative condition, as previously described;
- a second control unit 170 which is installed on board of said second train 111 and is configured to generate a respective electrical activation $S_A$ suitable to switch the secondary pneumatic circuit 150 of the second train coupler 100 between its first operative condition and its second operative condition, which correspond to the first and second operative configurations of the secondary pneumatic circuit 50 of the first train coupler 100.

Accordingly, once the train couplers 1 and 100 are mechanically coupled and pneumatically coupled, the issuance of an electrical activation signal $S_A$, by one of the first and second control units 70 or 170, e.g. the first control unit 70 (or alternatively the second control unit 170) switches the corresponding secondary circuit 50 (or alternatively 150) from its first operative condition to its second operative.

As a consequence, derived flows of air $F_D$ are permitted towards, inside both the secondary pneumatic circuits 50 and 150, and pneumatically actuate the actuating means 35 and 135 of both the first and second train couplers 1 and 100 to drive the respective electrical heads 30 and 130 to move to the respective extended position and electrically couple to each other.

In practice, if the electrical activation signal $S_A$ is generated by the first control unit 70, then the secondary circuit 50 is switched in the second operative condition and the first actuating means 35 are operated pneumatically, via the derived flows $F_{D1}$, and drive the electrical head 30 into the extended position; at the same time, the derived second flows of air $F_{D2}$, via the mating second inlet/outlets 51 and 151, are conveyed into the secondary pneumatic circuit 150 of the second train coupler 100 and pneumatically actuate the first control means 154.

In this way, the second actuating means 135 are pneumatically operated and drive the second electrical head 130 to move to its extended position and electrically couple with the first electrical head 30.

Practically, the same occurs in a mirrored way if the electrical activation signal is issued by the second control unit 170 on board of the second train 111.

In this way, a single electrical activation $S_A$ signal triggers the movement and mutual coupling of the electrical heads of both couplers, and hence the two trains can be coupled also electrically even if one of the trains under coupling is completely dead and does not have any suitable power supply available on board.

Figure 6:
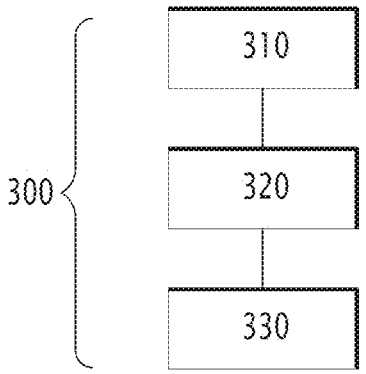
FIG. 6 is a flow chart schematically illustrating a method for coupling trains according to the present invention.

FIG. 6 illustrates a method 300 for coupling trains, which comprises:

310: driving a first train 110 provided with a first train coupler 1 as previously described, and in particular as defined in the relevant appended claims, toward a second train 111 provided with a second train coupler. In particular the second train coupler can be substantially identical to first train coupler 1, as illustrated in FIG. 2 where the second coupler is indicated by the reference number 100;

320: coupling mechanically and pneumatically the first train coupler 1 to the second train coupler, e.g. to the second train coupler;

330: issuing, via a control unit 70 (or alternatively 170) installed on one of the first and second trains 110 or 111 an electrical activation signal $S_A$ thus switching the corresponding secondary circuit 50 (or alternatively 150) from its first operative configuration to its second operative configuration where the derived flows of air $F_D$ are permitted, inside both the secondary pneumatic circuits 50, 150 of the first and second train couplers 1 and 100, to flow towards and pneumatically actuate the respective first actuating means 35 and 135 of both the first and second train couplers 1 and 100 to drive the corresponding electrical heads 30 and 130 of the first and second train couplers 1, 100 into to the respective extended position and electrically couple to each other.

Hence, it is evident from the foregoing description that the train coupler 1, the coupling system 200, the method 300, and the train 110 according to the present invention allow achieving the intended aim.

Indeed, the train coupler 1 has a simplified coupling system which requires basically only the two simple valves 54 and 58 and two derived air distribution lines 52 and 56 in order to allow an automatic coupling also from an electrical point of view; in particular, the automatic coupling with another train coupler is realized completely automatically without the manual intervention of an operator on the tracks, thus improving safety.

Also, the present invention allows to isolate electrical coupling from healthy train in case of any electrical fault.

The train coupler 1, the coupling system 200, the method 300, and the train 110 thus conceived are susceptible of modifications and variations, all of which are within the scope of the inventive concept as defined in particular by the appended claims; for example, the processing unit 70 can be constituted by, or comprise, any suitable processor-based device, e.g. a processor of a type commercially available; the control means may comprise a different type of valves provided that they allow to properly perform the functionalities devised for them within the frame of the present invention; the other train coupler can be differently configured with respect to the embodiment illustrated in FIG. 2, provided that it is compatible with the scope and functioning devised within the frame of the present invention.

All the details may furthermore be replaced with technically equivalent elements.

What is claimed is:

1. A train coupler comprising:

a mechanical coupler configured to couple with another train coupler;

a primary pneumatic circuit comprising a main air distribution line adapted to be connected with and supply air into a pneumatic circuit of said another train coupler, via a first inlet/outlet;

a movable electrical head connected to a first actuator which is configured to be pneumatically actuated and drive the electrical head to move between a non-operative retracted position and an extended position where it is adapted to be electrically coupled with an electrical head of said another train coupler;

a secondary pneumatic circuit which is pneumatically connected to said primary pneumatic circuit and is arranged to convey flows of air derived from said main air distribution line towards said first actuator and a second inlet/outlet, the second pneumatic circuit being configured to be pneumatically connected with the pneumatic circuit of said another train coupler via the second inlet/outlet, wherein said secondary pneumatic circuit is configured to be switched, based on an electrical activation signal generated by a train controller, between a first operative configuration where the derived flows of air towards said first actuator and said second inlet/outlet are blocked, and a second operative configuration where said derived flows of air are permitted pneumatically actuating at least said first actuator to drive the electrical head to move to the extended position for electrically coupling with the electrical head of said another train coupler.

2. The train coupler according to claim 1, wherein said secondary pneumatic circuit comprises a first air distribution line which is arranged to convey first flows of air derived from the main air distribution line towards said first actuator.

3. The train coupler according to claim 2, wherein said secondary pneumatic circuit comprises first flow-controller which are positioned along said first air distribution line and are configured to be actuated pneumatically to move from a first normally blocking position where said first flows of air conveyed towards said first actuator are blocked, and an actuated second position where said first flows of air towards said first actuator are permitted.

4. The train coupler according to claim 3, wherein said first flow-controller comprise a first bistable valve comprising first elastic part configured to urge said bistable valve in said first normally blocking position.

5. The train coupler according to claim 4, wherein said first bistable valve is a 5-way-two-position valve.

6. The train coupler according to claim 3, wherein said secondary pneumatic circuit comprises a second air distribution line which is arranged to convey second flows of air derived from the main air distribution line towards said second inlet/outlet and said first flow-controller.

7. The train coupler according to claim 6, wherein said secondary pneumatic circuit comprises second flow-controller which are positioned along said second air distribution line and are configured to be activated electrically by said electrical activation signal to switch from a first normally blocking position where said second derived flows of air to be conveyed towards the second inlet/outlet 51 and the first flow-controller are blocked, and an actuated second position where said second derived flows of air are allowed to pneumatically actuate said first controller to move from their first normally blocking position into their actuated second position.

8. The train coupler according to claim 7, wherein said second flow-controller comprise a second bistable valve comprising second elastic component configured to urge said second bistable valve in its first normally blocking position.

9. The train coupler according to claim 8, wherein said second bistable valve is a 3-way-two-position valve.

10. The train coupler according to claim 1, wherein said first actuator comprises a pneumatic cylinder.

11. The train comprising the train coupler according to claim 1.

12. A coupling system for coupling a first train to a second train, comprising:

the first train coupler according to claim 1, which is installed on said first train;

the second train coupler according to claim 1, which is installed on said second train;

a first controller which is installed on board of said first train and is configured to generate an electrical activation signal to switch the secondary pneumatic circuit of the first train coupler between its first operative configuration and its second operative configuration;

a second controller which is installed on board of said second train and is configured to generate an electrical activation signal to switch the secondary pneumatic circuit of the second train coupler between its first operative configuration and its second operative configuration;

wherein, upon mechanically and pneumatically coupling said first train coupler with said second train coupler, the issuance of an electrical activation signal, by one of the first and second controllers switches the secondary pneumatic circuit of the corresponding first or second train couplers from its first operative configuration to its second operative configuration where flows of air are permitted, inside the secondary pneumatic circuit of both the first and second train couplers, and pneumatically actuate the first actuator of both the first and second train couplers to drive the respective electrical heads to move to the respective extended position and electrically couple to each other.

13. A method for coupling trains, comprising:

driving a first train comprising the first train coupler according to claim 1, towards a second train comprising the second train coupler according to claim 1;

coupling mechanically and pneumatically said first train coupler to said second train coupler;

issuing, via a controller installed on one of the first and second trains an electrical activation signal switching the corresponding secondary pneumatic circuit of the first or second train couplers from its first operative configuration to its second operative configuration where derived flows of air are permitted, inside both the secondary pneumatic circuits of the first and second train couplers, pneumatically actuating the respective first actuator to drive the corresponding electrical heads of the first and second train couplers into the respective extended position and electrically couple to each other.

* * * * *